US005544961A

United States Patent [19]

Fuks et al.

[11] Patent Number: 5,544,961

[45] Date of Patent: Aug. 13, 1996

[54] TWO-PHASE SUPERSONIC FLOW SYSTEM

[75] Inventors: Efim Fuks; Vadim Fuks, both of Herzlia, Israel; Vladimir Lunev; Sergey Lunev, both of Odessa, Ukraine

[73] Assignee: April Dynamics Industries Ltd., Israel

[21] Appl. No.: 256,910

[22] PCT Filed: Feb. 8, 1993

[86] PCT No.: PCT/UA93/00001

§ 371 Date: Sep. 15, 1994

§ 102(e) Date: Sep. 15, 1994

[87] PCT Pub. No.: WO93/16791

PCT Pub. Date: Sep. 2, 1993

[30] Foreign Application Priority Data

| | | | |
|---|---|---|---|
| Feb. 11, 1992 | [EP] | European Pat. Off. | 92102259 |
| Feb. 11, 1992 | [IL] | Israel | 100918 |
| Nov. 12, 1992 | [IL] | Israel | 103735 |
| Jan. 24, 1993 | [IL] | Israel | 104495 |

[51] Int. Cl.[6] ..... B01F 15/02

[52] U.S. Cl. ..... 366/163.2; 99/324; 99/452; 99/485; 165/47; 366/349; 137/3

[58] Field of Search ..... 366/163.2, 163.1, 366/167.1, 348, 349, 108, 116, 124, 127, 324; 099/451, 452, 455, 456, 458, 483, 484, 485, 467; 137/3, 888, 889; 165/47, 48.1, 132

[56] References Cited

U.S. PATENT DOCUMENTS

| | | | |
|---|---|---|---|
| 2,690,329 | 9/1954 | Gressly | 99/452 |
| 3,200,764 | 8/1965 | Saunders | 417/185 |
| 3,451,327 | 6/1969 | Nelson | 99/453 |
| 3,799,195 | 3/1974 | Victor | 137/3 |
| 4,634,559 | 1/1987 | Eckert | 137/3 |
| 4,781,467 | 1/1988 | Williams | 137/889 |

FOREIGN PATENT DOCUMENTS

| | | |
|---|---|---|
| 0399041 | 11/1990 | European Pat. Off. . |
| 0475284 | 3/1992 | European Pat. Off. . |
| 3005653 | 8/1981 | Germany . |
| 2170324 | 7/1986 | United Kingdom . |

OTHER PUBLICATIONS

International Search Report. Aug. 30, 1993.

*Primary Examiner*—Robert W. Jenkins
*Attorney, Agent, or Firm*—Greenblum & Bernstein P.L.C.

[57] ABSTRACT

A passive injector including, a flow generator having a first inlet for gas or vapor at a first pressure and an outlet for gas or vapor, a mixing region having an inlet for the gas or vapor leaving the flow generator at supersonic velocity and a second inlet for a liquid at a second pressure, wherein liquid is incorporated into the flow of gas or vapor while maintaining supersonic velocity and a primary flow tube section aligned with an outlet of the mixing region and having an inlet and an injector outlet, the inlet of the flow tube being preceded by a gap surrounded by a cavity, wherein the flow velocity of the mixture is supersonic at the inlet of the primary flow tube section and the supersonic flow changes to subsonic flow within the primary flow tube section.

47 Claims, 13 Drawing Sheets

FIG.12
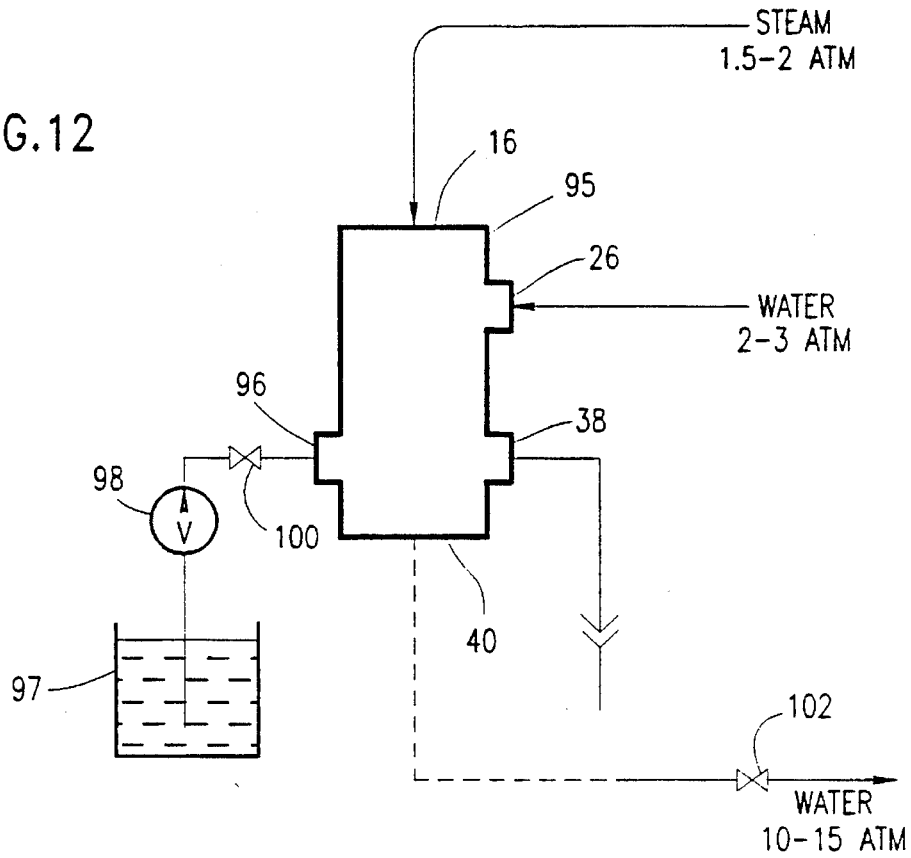
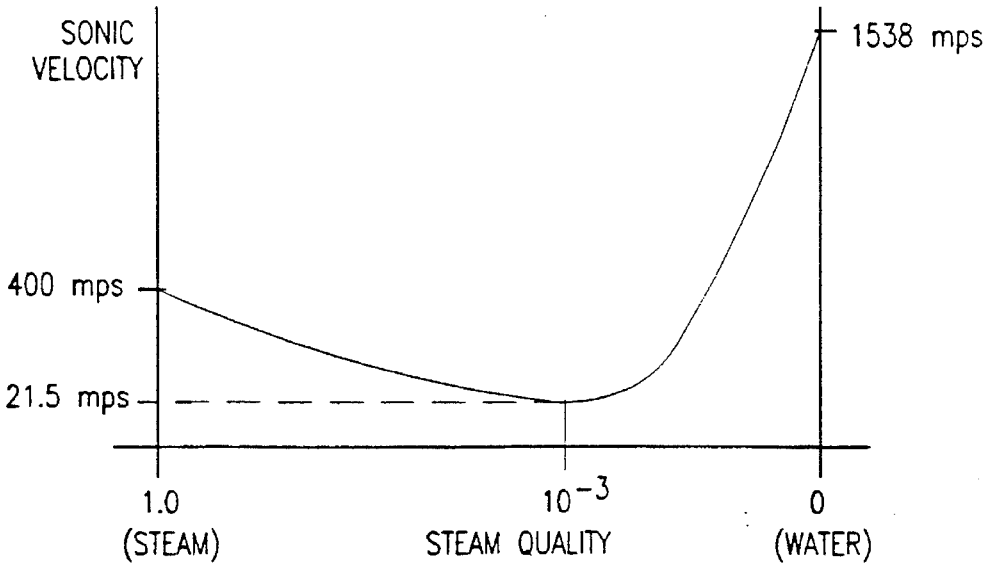
FIG.1B

TWO-PHASE SUPERSONIC FLOW SYSTEM

FIELD OF THE INVENTION

This invention relates to a two-phase supersonic flow system of the kind where a liquid-vapor or liquid-gas mixture flowing at supersonic speed undergoes continuous dissolving of the gas in the liquid, or condensation of the vapor. As a result, the specific volume is reduced while the velocity of sound, after reaching a minimum, increases and the flow changes from supersonic to subsonic. This gives rise to the formation of a transition region in which an abrupt rise in the pressure as well as a rapid completion of the dissolving of the gas or the condensation of the vapor occurs.

BACKGROUND OF THE INVENTION

Two-phase flow systems in which steam and water at relatively low pressure enter the system, flow together at supersonic speed and then leave the system, as water, flowing at subsonic speed at a pressure higher than that of either incoming component, have been known for over 115 years. In the past, such systems have been used to increase water pressure where steam is available. A classic use of such a system is to pump water into a boiler using live steam from the boiler.

Such known systems involve the use of supersonic steam flows which draw in water which enters the system. The two phase steam/water mixture enters an elongate flow tube in which the flow changes from supersonic to subsonic at a shock wave region where the pressure rises sharply. Downstream of the shock wave region there is generally a gap in the flow tube which is sometimes surrounded by a cavity having an egress opening for drainage.

As indicated in some of the references listed below, the gap/cavity/drainage system is used in the prior art systems during "start-up" to remove water which does not achieve the higher pressure which is achieved during operation.

Examples of such prior systems can be found in U.S. Pat. Nos. 177,313; 182,483; 209,220; 233,532; 280,589; 316,804; 338,950; 369,097; 440,488; 495,286; 501,271; 2,066,867; 4,252,572 and 4,951,713. Many of these patents are directed to the problems of start-up of the system and to its instabilities.

While such systems have been in use for many years, they were not well understood. Only in 1968 was a comprehensive theory of operation published by Deich, M. E. and Philippov, G. A. (in "Gas Dynamics of Two Phase systems," Moscow 1968, pp 267–274). This paper predicted that there is a theoretical limit to the amount of pressure step-up ratio which could be achieved, and that this limit was 5–7:1. In practice, commercially available supersonic injectors, such as the MIH-Jet models MBC-1 and MBC-2 manufactured by Jordan Equipment Co. of Houston, Tex., U.S.A. operate at pressure step up ratios between 2 and 2.5:1.

EP 0 150 171 describes a supersonic injector utilizing gas absorption in a supersonic liquid-gas mixture, resulting in a shock wave region.

SU 1281761 describes an injector which includes a supersonic steam injector opening into a mixing chamber followed by a flow tube. The inventor theorized that, for stable operation of injectors, it is necessary that the range of the ratio of the diameters of the outlet from the steam injector to the diameter of the flow tube be between 1.1–1.7:1 for highest possible pressure rise and for stable operation.

WO 89/10184, also published as EP 0 399 041, describes an emulsifier utilizing a passive injector. In this system steam, oil and water enter the system at separate entrances and exit the system as emulsified oil in water at an exit.

SU 1507299 describes a system in which a passive supersonic injector without a gap is used to pasteurize a liquid whole milk substitute.

U.S. Pat. No. 3,200,764 describes a passive injector in which a supersonic stream of steam is mixed with water, in a mixing region, to form a subsonic mixture of steam and water. This subsonic stream becomes supersonic in a gap following the mixer due to continued condensation of the and impinges a diffuser in which a diffused shock wave is generated. A spike, which protrudes from the diffuser, initiates the shock wave, which appears to extend over a substantial length.

EP 0 475 284 describes a system in which two fluids mixed at a supersonic speed. The mixture, is first made to flow at supersonic speed before entering a flow tube in which the flow becomes subsonic. This publication alleges that this results in an increase in pressure at the output of the system.

SUMMARY OF THE INVENTION

One aspect of the present invention is in the provision of an injector having improved operating characteristics. In this aspect of the invention, the pressure increase can be made higher than previously thought possible. Additionally, and in contrast with the prior art, the flow regime in the present invention is much more stable than in prior injectors. Furthermore, the temperature rise of the liquid is much lower than in the prior art for similar pressure step-up ratios, mainly because smaller amounts of steam are required for the same pressure step-up.

These and other advantages of the invention are achieved in a new mode of operation in which the vaporization energy of some of the vapor phase is transferred to the liquid over a much shorter region (and hence during a much shorter time interval) than was known in the prior art, such that the proportion of vapor phase energy transformed to heat is reduced, and thus a higher proportion of said energy is transformed to potential energy (pressure) at the output of the system.

The improved injector comprises a steam nozzle having a nozzle inlet for receiving a vapor or a gas, such as steam, and for producing steam traveling at supersonic velocity. The injector also includes a mixing chamber downstream of the nozzle for receiving the vapor or gas moving at supersonic speed and mixing it with a liquid which enters the injector via a separate inlet. In the preferred embodiment of the invention the liquid is drawn in to the supersonic flow and the mixed stream travels at supersonic speed.

While the velocity of the mixture drops during the incorporation of liquid into the stream, the sonic velocity of the mixture is a strong function of the ratio of the amounts of liquid and vapor as-shown in FIG. 1B. Thus a properly designed system can incorporate very substantial amounts of liquid into the stream, with the flow remaining supersonic.

The mixture leaves the mixing chamber at supersonic speed preferably into a preliminary flow tube section. The preliminary flow tube portion is followed by a gap surrounded by a chamber. The stream remains supersonic during this flow.

Downstream of the gap, the supersonic stream enters a primary flow tube in which the vapor further condenses or the gas is further dissolved in the liquid, the velocity of sound rises (after falling to a minimum value, see FIG. 1B) while the specific volume of flow is somewhat further reduced. When the velocity of sound rises to the velocity of the mixture a shock-wave region is formed in which the mixture completes the transition from liquid/vapor to liquid and a step up of potential energy (pressure) occurs.

In the flow tube sections, the flow is constrained by the walls of the tubes; in the gap the flow may be considered as being unconstrained by any physical structure.

The major technical advance of the invention is that the shock-wave region is formed downstream of the gap rather than before (upstream of) the gap as in those prior art systems which have such 8 gap. When the output is constricted, it has been found that the shock-wave region does not cross the gap from the primary flow tube to the preliminary flow tube as expected, but rather is compressed (reduced in extent in the flow direction) with the gap acting as a barrier to further backward movement of the shock region. In such a situation, the condensation or absorption is completed very quickly so that there is less time for the water to be heated. This results in higher pressure than was known in the art and lower temperature increase.

Furthermore, in contrast with EP 0 475 284 in which the flow becomes subsonic during the mixing of the two fluids, in the present system the flow remains supersonic, thereby avoiding the shock wave which is formed during transition from subsonic to supersonic flow in the European publication. This shock wave will, it is believed cause the vapor to completely condense and reduce, if not eliminate, any improved pressure increasing effect caused by the supersonic to subsonic transition.

If the output, in the system of the present invention, is further constricted (or alternatively, if the pressure at the output is increased by other means), the additional mechanical energy generated in the shock region is insufficient to force all the material which has passed through the shock wave region to pass through the constriction and some of the liquid which has passed the shock region is returned to the gap and exits the injector from a side drain. If the side drain is non-existent or does not allow for low pressure outflow of liquid, the amount of constriction possible with stable flow, and the related pressure rise, are limited.

Thus, the injector of the present invention contains. no new parts, per se; but the positions, lengths and diameters of the parts of the injector of the present invention are designed to allow for the above-described and previously unknown operating regimes.

Such injectors may be considered passive, which when used herein, is defined as having no source of energy other than the gas or vapor and liquid which enters the injector.

It has been found that when a supersonic nozzle, preferably of the Laval type, is used as the injector for steam for injectors of the present invention, the ratio of its outlet diameter to the diameter of the flow tubes can have a range which is wider than that previously thought possible for passive injectors. In particular, ratios as low as 0.8 or as high as 2, 3, 4 or more have been found to be suitable although the prior art theory indicates that stable supersonic flow can be maintained only for ratios of 1.1 to 1.7. These ratios are for the diameters of the respective sections. Non-circular cross-sections can also be used in the present invention, in which case the equivalent cross-sectional areas are relevant to the operation of the injector.

The second structural feature of the injector of the present invention, which is different from the prior art, is the provision of a shorter preliminary flow tube section. This shorter section assures that the supersonic to subsonic shock wave region forms after the gap so that the gap compresses the shock wave region for a constricted output. This compression is increased, and the pressure is also increased, as the output is further constricted. In prior art systems, the output pressure also increases with constriction of flow; however, the maximum increase attainable for given input conditions is much lower than in the injectors of the present invention. Beyond this lower maximum characteristic of such systems, the supersonic flow regime collapses in prior art systems.

The lower temperature rises which are achieved for the same pressure rise in the present invention allow for many new applications which were not known using prior art injectors.

In one embodiment of the invention, a supersonic injector is used to homogenize or emulsify a mixture. In this embodiment, an un-emulsified mixture-for example, of water and fat-is mixed with a supersonic jet of steam. The mixture enters a flow tube and a shock region forms. It has been found that, in this shock region, homogenization or emulsification of the mixture takes place. In the prior art it was known to emulsify a fat in water only when the two were added separately. The present inventors have found that emulsification of an already-mixed fat/water mixture to achieve homogenization is accomplished in the injectors of the present invention. Furthermore, the degree of emulsification using the injectors of the present invention is superior (smaller fat globules) than that produced by the prior art devices.

In a second embodiment of the invention, a supersonic injector is used to sterilize a liquid at relatively low temperature. It is believed that microbes are killed in the shock region even though the temperature is relatively low and the shock is applied for a short time. Due to the compressed shock wave, this sterilization takes place at a lower temperature than in the prior art systems for which only pasteurization and not sterilization has been reported.

In particular, it has been found that milk can be both homogenized and sterilized at a temperature of only 110° C. compared to temperatures of 140° C. which have been used in the past for producing UHT sterilized milk. This results in much better flavor for the milk. Furthermore, the homogenization is better than that obtained using prior art methods. The equipment used is more than an order of magnitude cheaper than homogenization and sterilization equipment presently in use. Sterilization at lower temperatures is also believed possible using injectors of the present invention.

In a third embodiment of the invention, spent steam is used for applications which previously required live steam. For example, in a turbine system, steam directly from the boiler would generally be required to power an injector pump of the prior art for pumping water into the boiler. With the higher pressure rise available for injectors of the present invention it is possible to use spent steam which exits from the generator.

In a fourth embodiment of the invention, injectors are used to add small amounts of water (from steam) to fuel in an injector for internal combustion engines or fuel burners. It is known that a small amount of water in the fuel improves the efficiency of combustion and the present invention provides an efficient way to provide fuel injection and addition of water at the-same time without using a mechanical pump.

In a fifth embodiment of the invention, mechanical energy can be generated from spent steam by using the steam to provide a high pressure stream of water which can be used directly or to drive a generator.

In a sixth embodiment of the invention, an injector is used to cook and homogenize materials such as pea soup or humus (chickpea paste) resulting in a much simpler manufacturing process. Such systems can be used for dispensers of hot soup in restaurants or other food service facilities.

In a seventh embodiment of the invention, an injector is used in a pumpless, recirculating, hot water heating system.

The injector of the present invention also has many additional uses, such as for dissolving gas in liquid, such as for soda water, for adding detergent or foaming agent to water, for pumping liquids and for producing high pressure heated water flow using lower input pressure steam than heretofore thought possible.

BRIEF DESCRIPTION OF THE DRAWINGS

The present invention will be better understood from the following description of the preferred embodiments taken together with the following drawings in which:

FIG. 1B shows the relationship between sonic velocity and steam quality in a steam water mixture;

FIG. 12 is a simplified schematic drawing of a system suitable for cleaning or foaming applications utilizing the injector of FIG. 11 in accordance with a preferred embodiment of the invention;

DESCRIPTION OF THE PREFERRED EMBODIMENTS

Figure 1A:
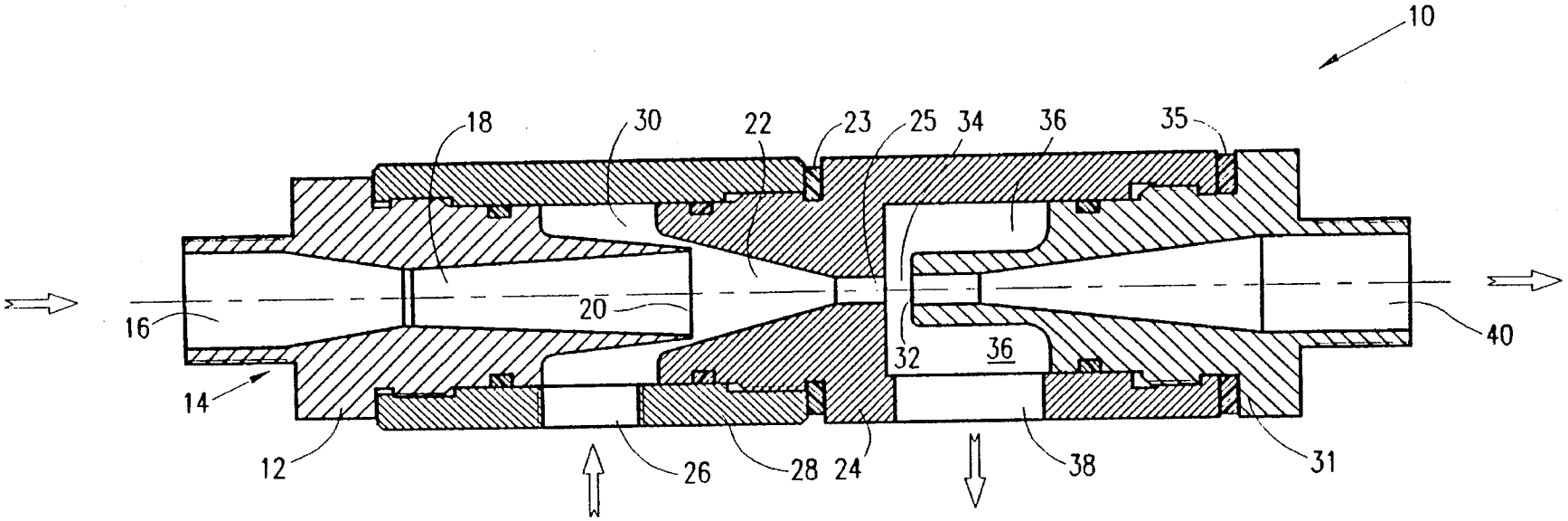
FIG. 1A is a cross-sectional drawing of an injector in accordance with a preferred embodiment of the invention.
Figure 2A:
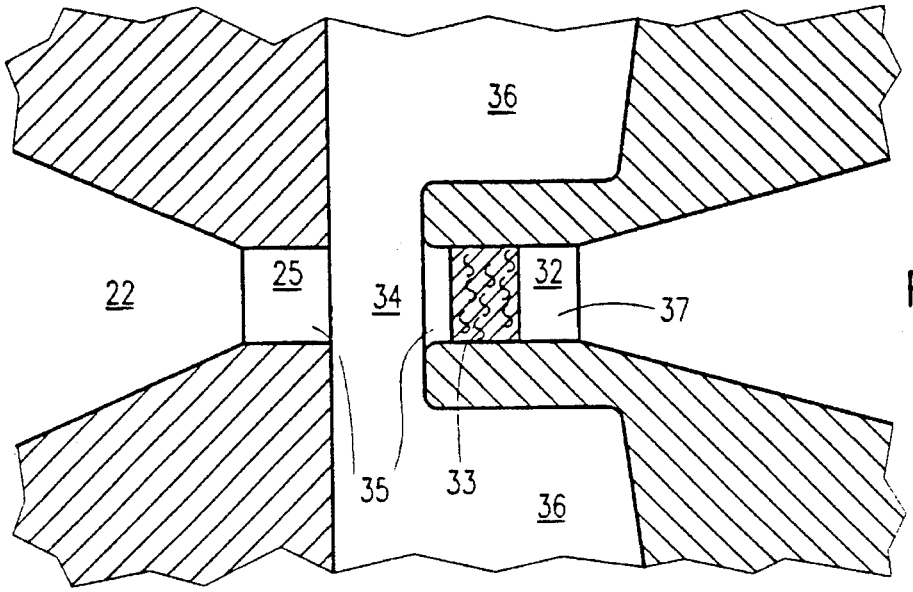
FIGS. 2A and 2B are cross-sectional views of a portion of the injector of FIG. 1, showing the different flow regions of the injector for different flow rates.
Figure 2B:
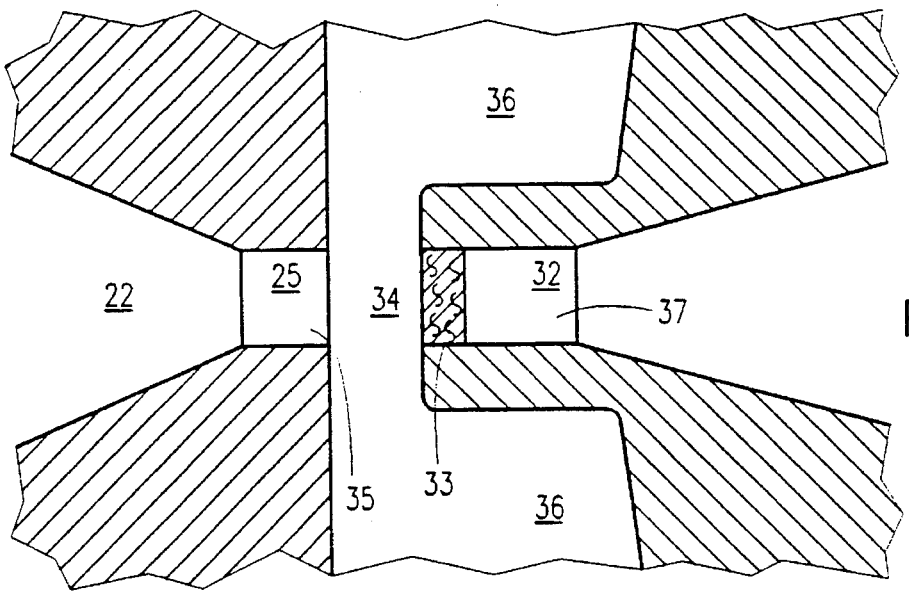

Referring now to FIGS. 1A, 2A and 2B, injector 10 comprises a steam input section 12 having formed therein an steam nozzle 14 comprising a steam inlet 16 and a supersonic section 18 having an exit 20. While a Laval type supersonic nozzle is shown, other nozzles which produce supersonic steam are equally suitable for use in the present invention. Gas or vapor such as steam enters steam inlet 16 and exits nozzle 14 at exit 20 preferably at a supersonic velocity into a mixing chamber 22 formed in a housing 24. Also formed in housing 24, opposite exit 20, is a preliminary flow tube section 25.

Due to its high velocity, the steam generates a vacuum in mixing chamber 22 and thus also at a liquid inlet 26, which is formed in a housing 28. Housing 28 also joins and positions injector section 12 and housing 24 and defines, together with section 12 and housing 24, a liquid inlet chamber 30 through which incoming liquid travels from inlet 26 to mixing chamber 22.

In general the proportion of liquid to steam entering chamber 22 is between about 100:1 and 5:1 by weight; however, the volume of steam in the mixture is initially much greater than that of the liquid.

As a result of the low pressure of the vapor or gas stream in chamber 22, liquid is drawn into and carried along with the supersonic stream. As this liquid is drawn into the stream, the velocity of the stream drops. However, as the steam quality (i.e., the proportion by weight of vapor phase) falls, the velocity of sound reaches a minimum value and increases with further reduction of the steam proportion. A curve of sound velocity as a function of steam quality is shown in FIG. 1B which is adapted from U.S. Pat. No. 3,200,764. It is a characteristic of the preferred embodiment of the invention that the velocity of the mixed stream remains supersonic during its travel through the mixing chamber 22.

If the vapor which enters inlet 16 is steam, then the steam condenses as it mixes and travels with the colder liquid which enters at inlet 26. This causes a decrease in the specific volume of the mixture and a decrease in the velocity of sound of the mixture (until the steam quality falls to a value of $10^{-3}$) as well as a slower but continuous decrease in the velocity of the mixture as it travels through the system. Alternatively, if a gas enters inlet 16, it is chosen to be soluble in the liquid such that it is dissolved in the liquid during travel.

A vapor/liquid mixture having a supersonic velocity thus leaves mixing chamber 22 and enters preliminary flow tube section 25.

A primary flow section 32 is formed in an exit section 34 which is aligned with and attached to housing 24, such that the preliminary and primary flow sections are substantially aligned and a gap 34 is formed between the two flow tube sections. Gap 34 is connected with and preferably surrounded by a chamber 36 which preferably has an optional outlet 38.

During its flow in primary flow section 32, the specific volume and the steam quality will have decreased sufficiently so that the previous supersonic flow becomes subsonic such that a shock wave region 33 is formed following the region of supersonic flow 35 and prior to stable subsonic flow 37 as shown in FIG. 2A. The pressure gradient across shock-wave region 33 is very high. The present inventors have discovered that the pressure rise across the shock-wave region, and thus the output pressure, can be increased by decreasing the length of the shock wave region.

The high pressure liquid which results from the above process preferably exits the injector through liquid outlet 40 (FIG. 1A).

When flow from outlet 40 is partially restricted by a valve or the like, shock wave 33 in primary flow tube 32 moves toward the inlet as shown in FIG. 2B. Unexpectedly, gap 34 constrains further progress of the shock-wave. When the edge of the shock wave, under further restriction of the outlet, reaches gap 34 it does not cross the gap, nor does it become unstable. Instead, unexpectedly, the shock wave region is compressed and the gap acts as a barrier to the backward movement of the trailing edge of the shock wave region.

If the outlet is further restricted, the shock wave is further compressed and the output pressure further rises until it reaches some limit. At this point, the flow becomes unstable and the injector no longer operates in the manner described. However, if optional outlet 38 (FIG. 1A) is provided, as shown, then the system remains stable for a more restricted range of outlet flow volumes, and consequently higher exit pressures can be achieved. For such a flow regime, some of the liquid is found to leave optional outlet 38 at relatively low pressure. It has been found that, even when the flow from outlet 40 is reduced to zero, a very high static head exists at outlet 40, which head may be as large as 15 times the input pressure. At this point, all the liquid which enters the system leaves via outlet 38 at near atmospheric pressure.

Figure 2C:
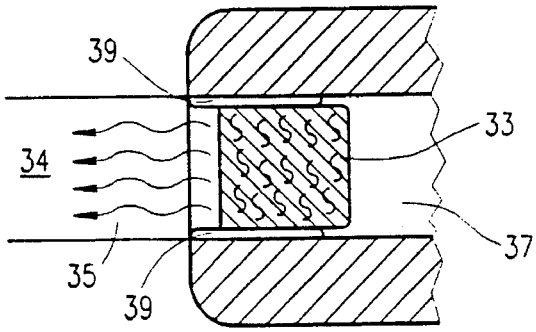
FIG. 2C is a more detailed cross-sectional view of the shock-wave region.

It is believed that the gap acts to constrain the shock wave region for the following reason, which is explained with the help of FIG. 2C, a more detailed view of the entrance to primary flow tube section 25. Between the walls of the primary flow section which is stationary and the supersonic flow region 35, a transition region 39 of subsonic velocity must exist. As is well known, pressure information cannot cross a shock wave from the region of subsonic to supersonic flow. As the output is constricted, the increase in pressure at the output is partially transmitted via the subsonic flow region 39 toward the input of the system.

At gap 34, the constraining walls end and, with them, the subsonic flow region. Thus, the post shock wave pressure information cannot be transmitted further back and the flow into the preliminary flow section is not affected. For low constriction of the output, the flow is hardly changed, even though the pressure is increased. For greater constriction, it is believed that a portion of the water/steam mixture passes through the shock-wave region 33 and then returns, as water, via region 39 to the gap. This water exits via optional outlet 38. It is believed that, in the injector of the present invention, no information about output flow and pressure reaches the preliminary flow tube and thus the input to the gap is unaffected. Furthermore, all of the mixture entering the preliminary flow tube is thus treated by the shock wave region.

In prior art systems in which there is no gap between the shock region and the mixing region, the output pressure and flow information is transmitted to the mixing chamber and the input flows and pressures are affected. In this way the output pressure is limited in a much greater degree in the prior art than in the present injectors.

Figure 3:
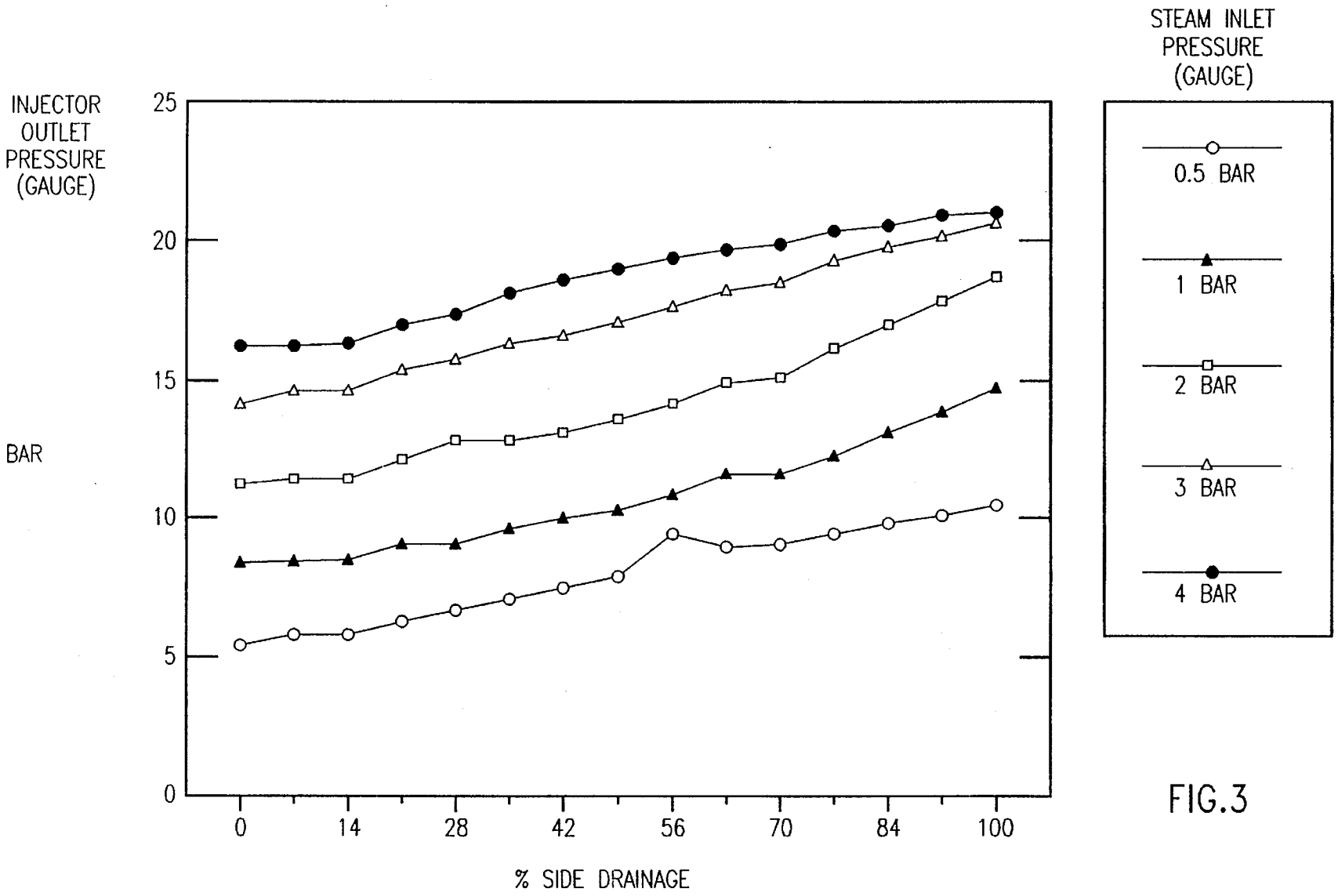
FIG. 3 is a graph of output pressure as a function of side drainage for various values of input steam pressure.

Results for an injector of the present invention are shown in FIG. 3. In this system, the diameter of steam exit 20 is 20 mm, the diameter of flow tubes sections 25 and 34 is 6 mm and gap 34 is 7 mm. The overall length of the system is 250 mm. In this figure, the output pressure of the injector is shown as a function of the percentage of side drainage for various inlet steam pressures. The water inlet pressure is one bar. As can be seen from this graph, for no side drainage, the pressure increase is between a factor of 3.5 and 4.5, with higher increases for low pressure steam at a pressure over one bar.

When the flow is constricted, the pressure rises, and the pressure ratio can be as high as 5.5 for high pressure steam and over 15 for low pressure steam.

As shown in FIG. 3, the injector of the present invention can be dimensioned to provide for the above regime to occur over a wide range of steam and water pressures.

In general, a steam injector of the present invention is specified by (a) the system throughput, (b) the allowed temperature rise for the liquid, (c) the desired pressure rise, (d) the viscosity and other parameters of the liquid material, (e) the input pressure and temperature of the liquid material and (f) the input temperature and pressure of the steam.

In a preferred embodiment of the invention, the dimensions of the system are chosen in the following manner: First, the maximum Mach number (which occurs at the minimum of sound velocity) is chosen. Higher Mach numbers give higher pressure rises; however, this also results in higher temperature rise for the liquid. Where the temperature rise should be limited, this limits the Mach number.

The diameter (i.e., the cross-sectional area) of the flow tubes is chosen to give the desired volumetric flow at the supersonic flow velocity corresponding to the maximum each number chosen. The length of the preliminary flow tube is preferably chosen such that the transition from supersonic to subsonic velocity does not take place until the mixed stream reaches the primary flow tube. The length of gap 34 is generally between 0.8 and 1.2 of the diameter of the flow tubes and is chosen empirically. Too long a gap results in the regime being unstable and collapsing; too small a gap and the available pressure rise is much reduced over the optimum available.

The throat of steam nozzle 14 is chosen to give the required amount of steam. Exit 20 is chosen to give a required steam velocity. Preferably, exit 20 has a diameter about 2–4 times that of the flow tubes, although smaller diameters for exit 20, down to about 0.8 can be used for low velocity steam applications. The gap between exit 20 and housing 24 are chosen to give the proper mix of steam and liquid. The cone angle of chamber 22 is not critical but should preferably be above about 15 degrees and is generally about 30 degrees. Larger angles are also operative in the performance of the invention.

For the example of FIG. 1A, resulting in the pressure curves of FIG. 3 at a flow rate of approximately 2000 to 4000 kg of water per hour at a temperature rise of 30° C. to 65° C. at a steam pressure of 1–4 atmospheres, some typical dimensions are: the Laval throat diameter is 12 mm; the diameter of exit 20 is 18 mm; the length of mixing chamber 22 is 29 mm; the preliminary flow tube section has a length of 10 mm and a diameter of 6 mm; the primary flow tube has a length and diameter of 37 mm and 6.5 mm respectively. Gap 34 is about 7 mm long and is adjustable with a spacer 35 (shown in FIG. 1) being provided to insure optimal spacing. The annular gap surrounding exit 20 is nominally 1 mm and adjustment for this gap is provided by a spacer 23. This gap would vary depending on the flow desired and the viscosity of the material.

For a flow rate of approximately 5000 to 8000 kg of water per hour at a temperature rise of 30° C. to 65° C. at a steam pressure of 1–4 atmospheres, some typical dimensions are: the Laval throat diameter is 17 mm; the diameter of exit 20 is 25 mm; the length of mixing chamber 22 is about 38 mm; the preliminary flow tube section has a length of 8 mm and a diameter of 9 mm; the primary flow tube has a length and diameter of 10 mm and 9 mm respectively. Gap 34 is about 9 mm long and is adjustable as described above. The annular gap surrounding exit 20 is nominally about 1 mm and adjustment for this gap is provided by spacer 23.

These values can be scaled using the criteria described above and can be varied, so long as the operating criteria for the flow injectors of the present invention are maintained.

Figure 4A:
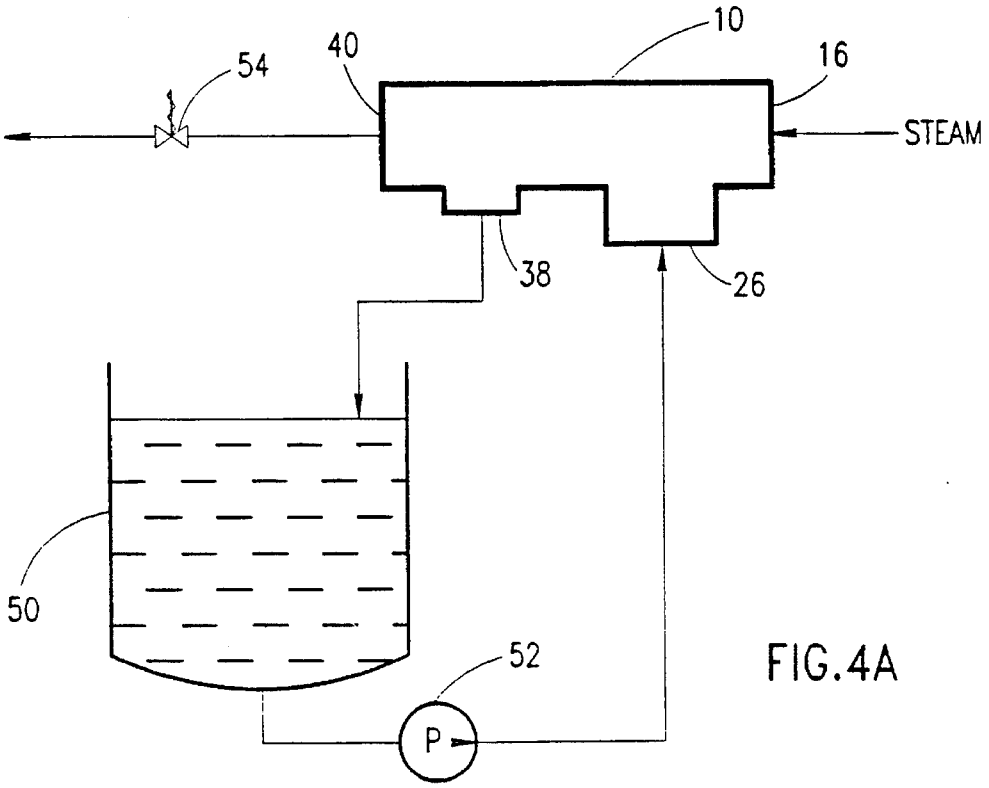
FIG. 4A is a simplified schematic drawing of a system suitable for sterilization (or pasteurization) and/or homogenization according to a preferred embodiment of the invention.

FIG. 4A is a schematic drawing of a system utilizing an injector suitable for sterilization (or pasteurization) and/or homogenization (or emulsification) of liquids or mixtures. An injector, similar to that shown in FIG. 1 has its steam input 16 connected to a source of steam. Liquid input 26 is fed from a source of untreated material 50 via a pump 52. The material which leaves injector 10 via outlet 40 is both homogenized (or emulsified) and sterilized (or pasteurized), depending on the type of material and on the pressures and temperatures involved. Preferably, no material leaves outlet 38, but any material which does can be returned to the untreated material source or can be used as is since such material is sterilized and homogenized tot he same extent as that which leaves outlet 40. An exit valve 54 controls the flow rate and thus the temperature and the pressure rise in the shock wave and the degree of sterilization and homogenization.

In experiments with unpasteurized and unhomogenized milk (input temperature 70° C.) using 6–7% steam (by weight), it was found that the product of the process was sterilized at a temperature of only 110° C. during the fraction of a millisecond during which the milk passed the shock zone. The milk was held at 110° C. for two and one-half seconds after passing through the shock zone. This compares with the 142° C. for two and one-half seconds required with commercial UHT sterilization equipment. Furthermore, the milk was homogenized to a much greater degree than with commercial homogenizers costing many times the cost of the present device. If required, the water added by the steam can be removed by evaporation.

In a particular experiment, steam at 3.5 bar was used to treat about two liters of milk a minute. The temperature of the milk reached about 110° C. The milk was found to be less affected in taste than ordinary UHT milk and had a long shelf life.

The present inventors believe that the sterilization is caused mainly by the bacteria being killed by the shock to which they are subjected in the shock wave region. In this region any fat globules are also subjected to tremendous shear forces which break them into globules much smaller than 1 micrometer. As is well known, such small particles stay emulsified and do not settle out of the emulsion. Apparently the emulsification caused by the injector of the present invention results in smaller fat globules than those produced by homogenizers of the prior art, and the homogenization lasts longer.

Figure 4B:
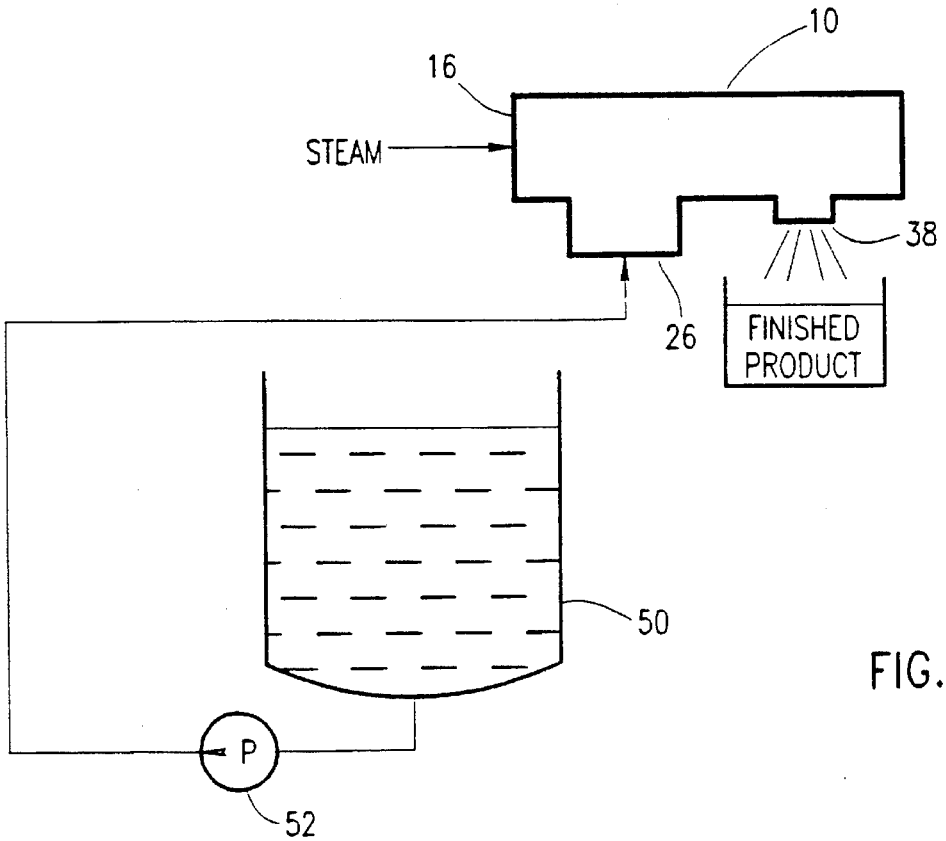
FIG. 4B is an alternative preferred embodiment of the sterilizer/homogenizer of the present invention.

In a variant of the system, the output valve 54 is closed and all of the material which enters the system exits via optional outlet 38. As described above, the material leaving outlet 38 has already been treated by the shock wave and is both sterilized and homogenized. Such a system is shown in FIG. 4B. The output material exits the injector at a lower pressure for the system of FIG. 4B than that for the system of FIG. 4A. Since the shock wave region of the injector is more compressed in the system of FIG. 4B, the material being treated will be subject to greater shock stress.

The system of FIG. 4B can also be used to prepare pea soup or humus (chickpea paste) or the like. For this application, the untreated material is powdered dried peas or chickpeas in water. The output of the system will be cooked, prepared pea soup or humus. Such a system is inexpensive and is especially suitable for use in a restaurant or other food service facility. The system of FIG. 4B can also be used for preparing a cooked food product starting with ground or pureed uncooked material.

While the maximum advantages of the system of FIGS. 4A and 4B are achieved by using the improved injector of the present invention with its relatively low temperature rise and short intense shock region, using injectors of the prior art may also achieve some of the advantages of the present invention, but will generally result in inferior performance (i.e., higher temperatures at the output and poorer homogenization).

Figure 5:
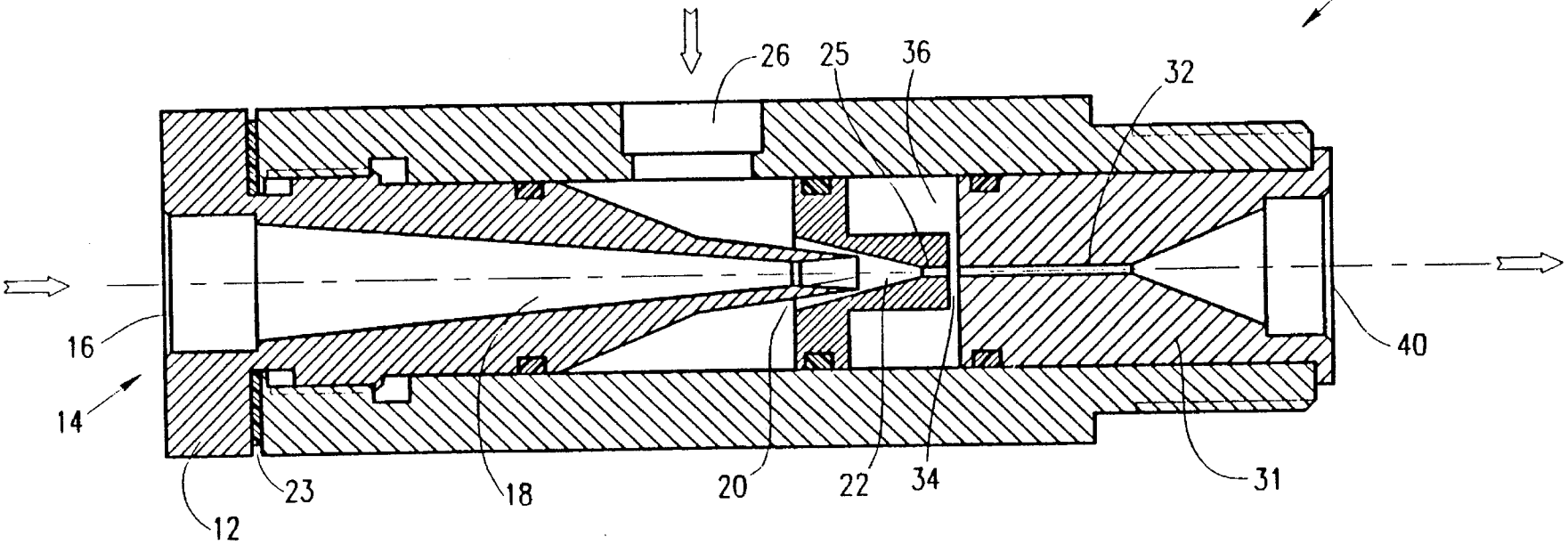
FIG. 5 is a cross-sectional drawing of a fuel/water injector in accordance with a preferred embodiment of the invention.

FIG. 5 shows a cross-sectional view of a fuel injector 60 according to the present invention. For simplicity, the reference numerals used in FIG. 1A are also used in this and subsequent drawings of the embodiments to denote corresponding features. This injector, which can be used both with heavy heating oils and for internal combustion engines, has the dual purpose of pumping the fuel and injecting it at a high pressure, and adding a small amount of water (from steam condensate) which is well-mixed with the injected fuel. It is known that adding a small amount of water to fuel improves the efficiency of combustion and the present injector provides a simple way of adding and mixing the water with the fuel while also pumping the fuel. Since very high pressures are not required for this application the system requires no drain from cavity 36.

For the example of FIG. 5, for a flow rate of approximately 100 to 200 liters of fuel per hour at a steam pressure of 1–4 atmospheres and a temperature rise of 30° C. to 120° C., some typical dimensions are: the Laval throat diameter is 2.8 mm; the diameter of exit 20 is 3.4 mm; the length of mixing chamber 22 is 4.8 mm; the preliminary flow tube section has a length of 5 mm and a diameter of 1.2 mm; the primary flow tube has a length and diameter of 15 mm and 1.2 mm respectively. The gap is approximately 1.2 mm. The annular gap surrounding exit 20 is nominally 1 mm.

Figure 6:
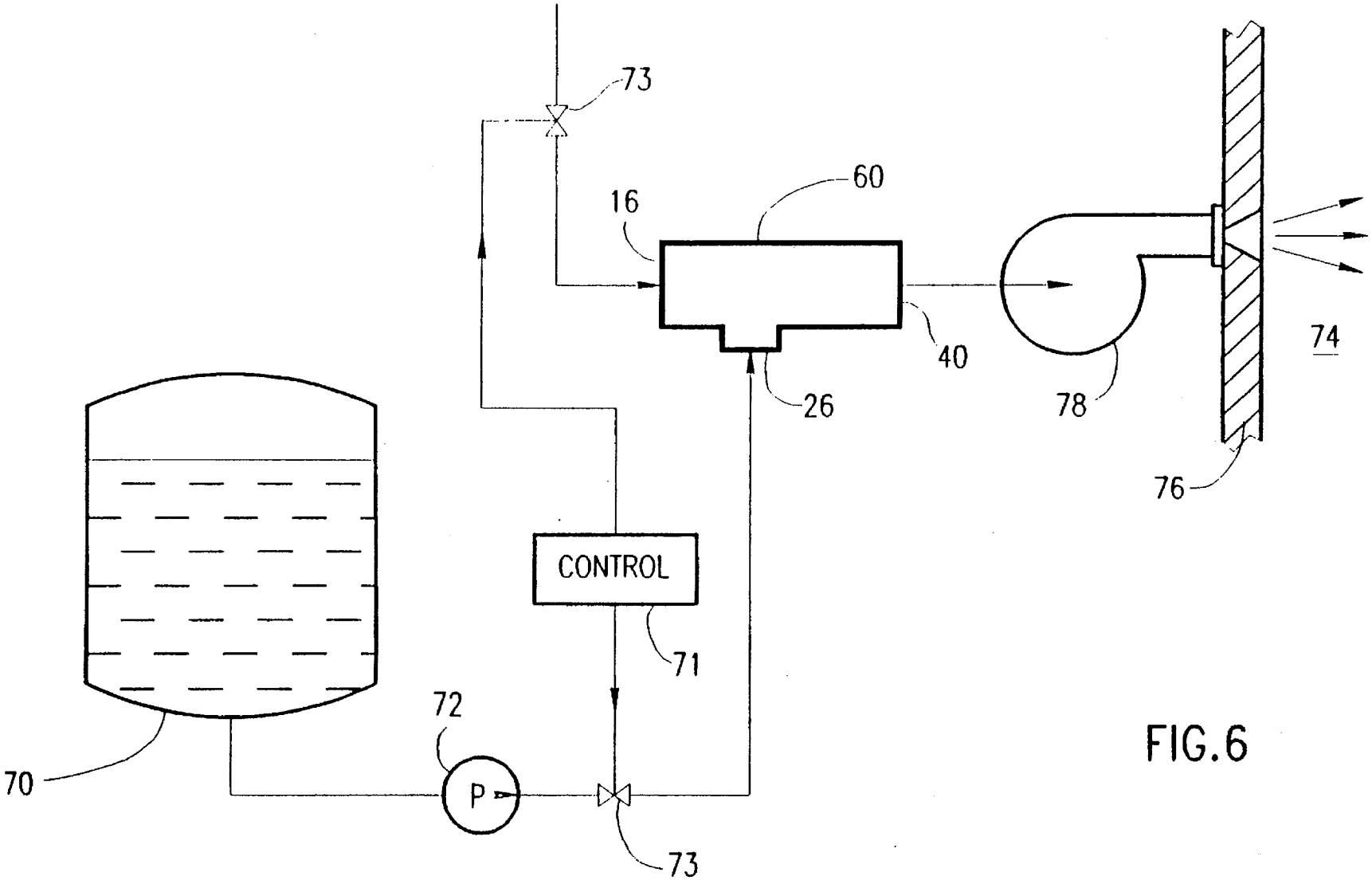
FIG. 6 is a simplified schematic drawing of a fuel injector system utilizing the fuel injector of FIG. 5.

FIG. 6 is a schematic drawing of a system for injecting heavy heating oil mixed with a small amount (up to 7%) of water. Injector 60 has its steam input 16 connected to a source of steam. Liquid input 26 is fed from a source of fuel oil 70 via a pump 72. The pressurized and wetted fuel oil is fed to burner 74 through wall 76 via blower 78, which mixes air with the fuel, for burning. Fuel and steam flow are controlled by a pair of valves 73, whose parameters are controlled by a controller 71.

Figure 7:
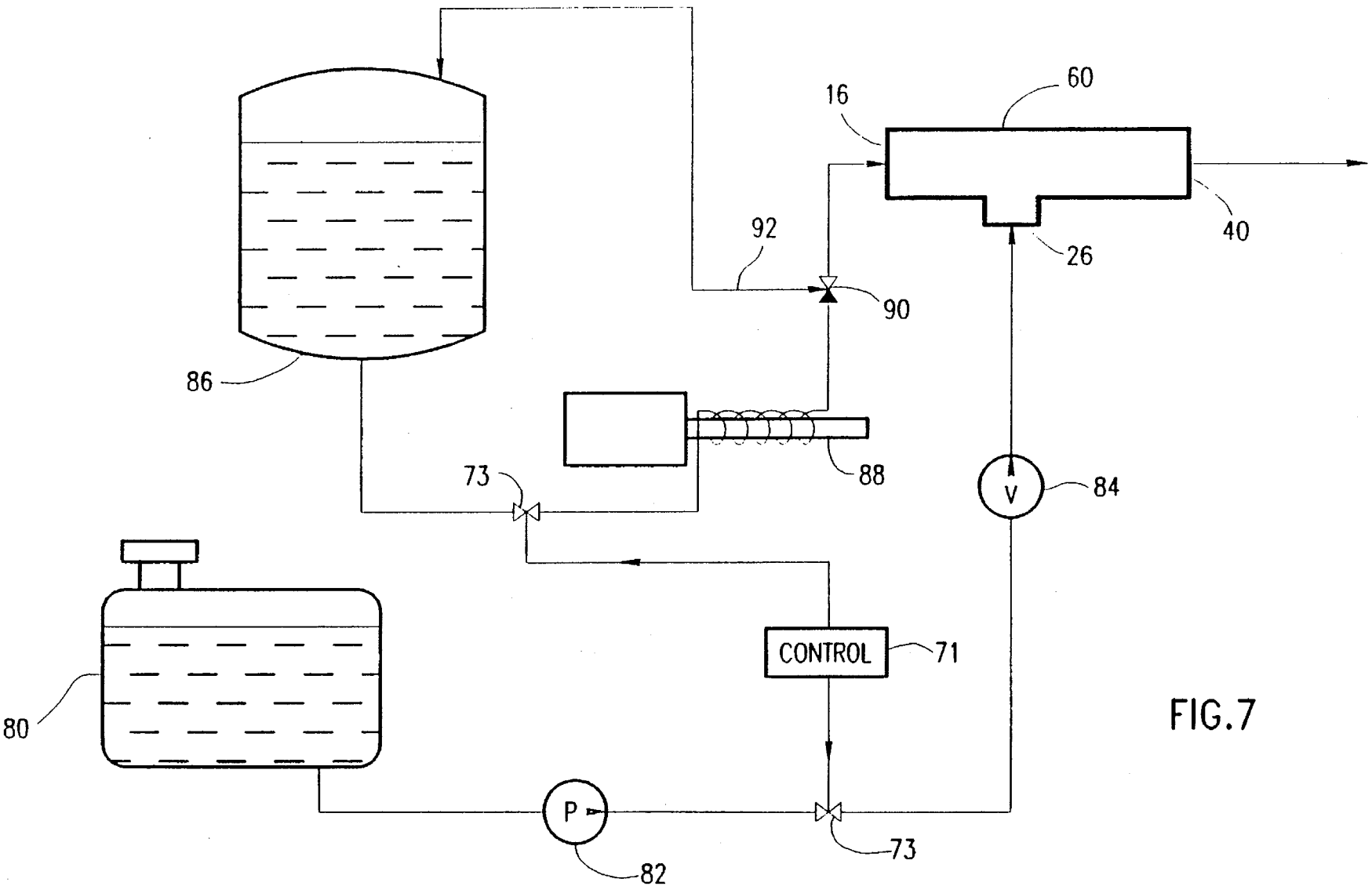
FIG. 7 is a simplified schematic drawing of an alternative preferred fuel injector system especially suitable for use with an internal combustion engine.

FIG. 7 is a schematic drawing of a system for treating and injecting fuel, especially suitable for an internal combustion engine. Injector 60 is fed by gasoline or other fuel from a fuel tank 80 via a pump 82 and a check valve 84. Water from a water tank 86 is heated by exhaust gases from the engine in a heat exchanger 88 to form low pressure steam which is fed to a one way valve 90. A pickoff 92 optionally supplies excess steam to tank 86 to increase water pressure and assure a steady supply of water. A portion of the steam which exits heat exchanger 88 is fed to injector 60 where it mixes with the fuel. The mixture which exits the injector at outlet 40 feeds the combustion chamber of the engine. Fuel control is similar to that of FIG. 6.

Figure 8:
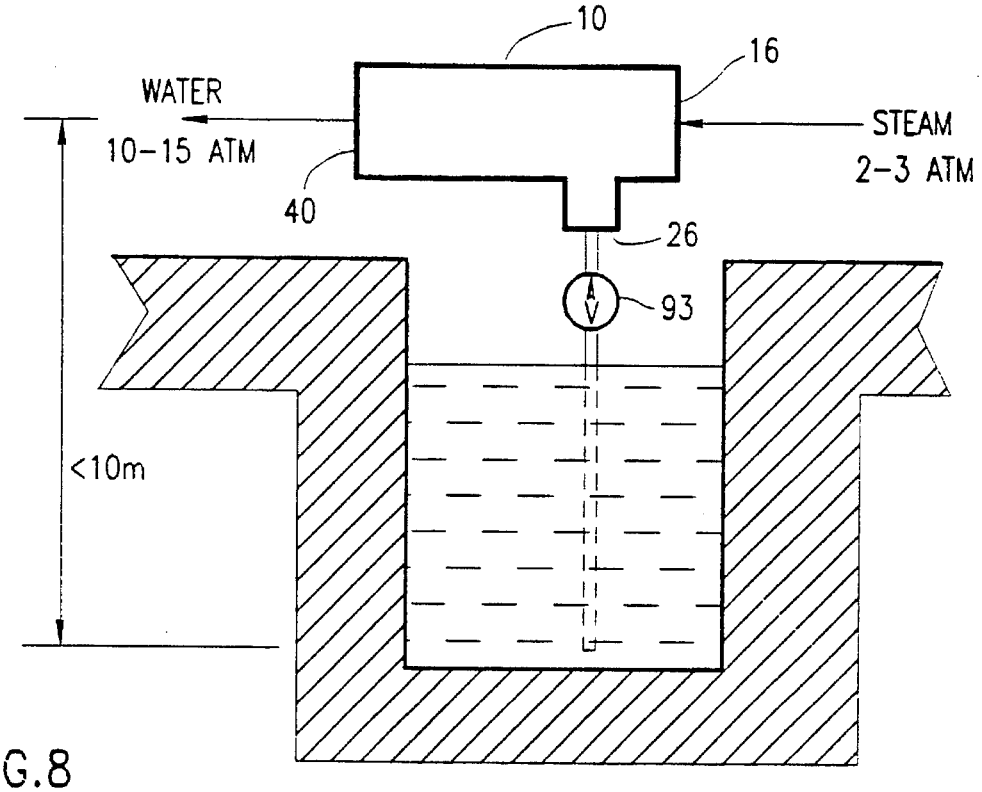
FIG. 8 is a simplified schematic drawing of the application of a variation on the injector of FIG. 1 to pumping a liquid.

FIG. 8 is a schematic drawing of a lifting pump system for water or other liquid. Water or other liquid is pumped from a hole or underground container by an injector 10 fed by a source of low pressure steam. Water enters inlet 28 via a check valve 93 and is ejected from the exit port 40 of the injector at high pressure. Auxiliary output 38 may be open or closed or non-existent as shown in FIG. 8, depending on the pressure rise required.

Figure 9:
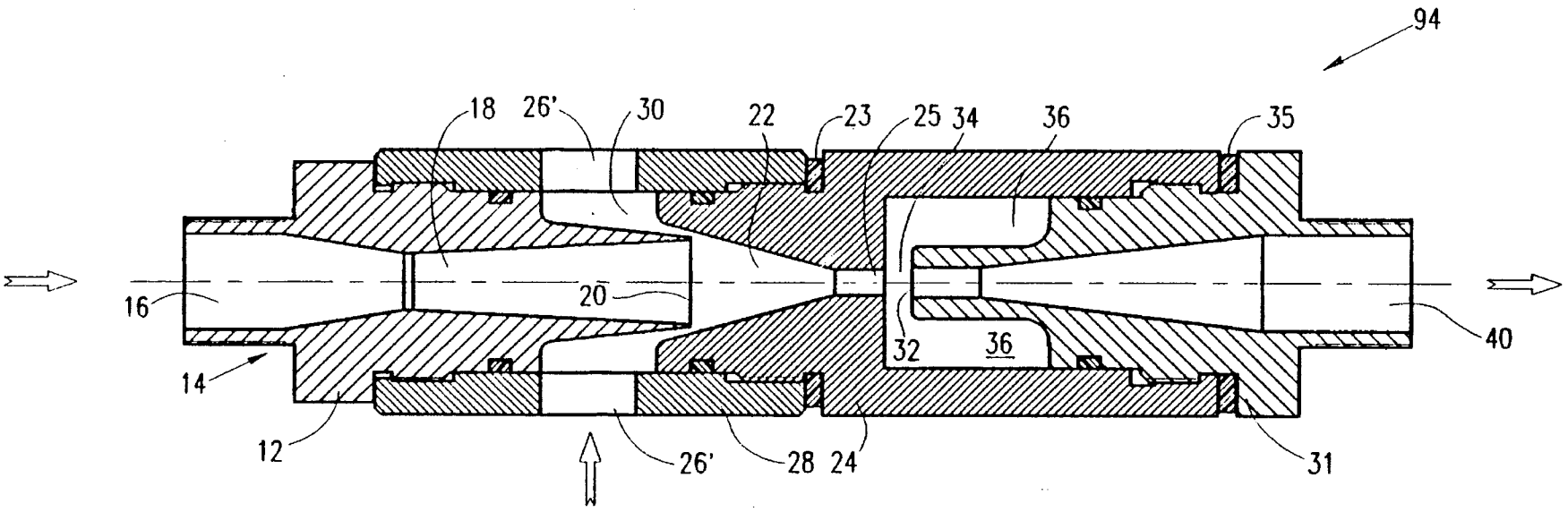
FIG. 9 is a cross-sectional drawing of an injector suitable for use as an immersion pump utilizing low pressure steam in accordance with a preferred embodiment of the invention.

FIG. 9 shows an alternative pumping injector 94 suitable for immersion pumping. It differs from the embodiment of FIG. 1A in that inlet 26 is replaced by a plurality of inlets 26' and the auxiliary outlet is closed.

Figure 10:
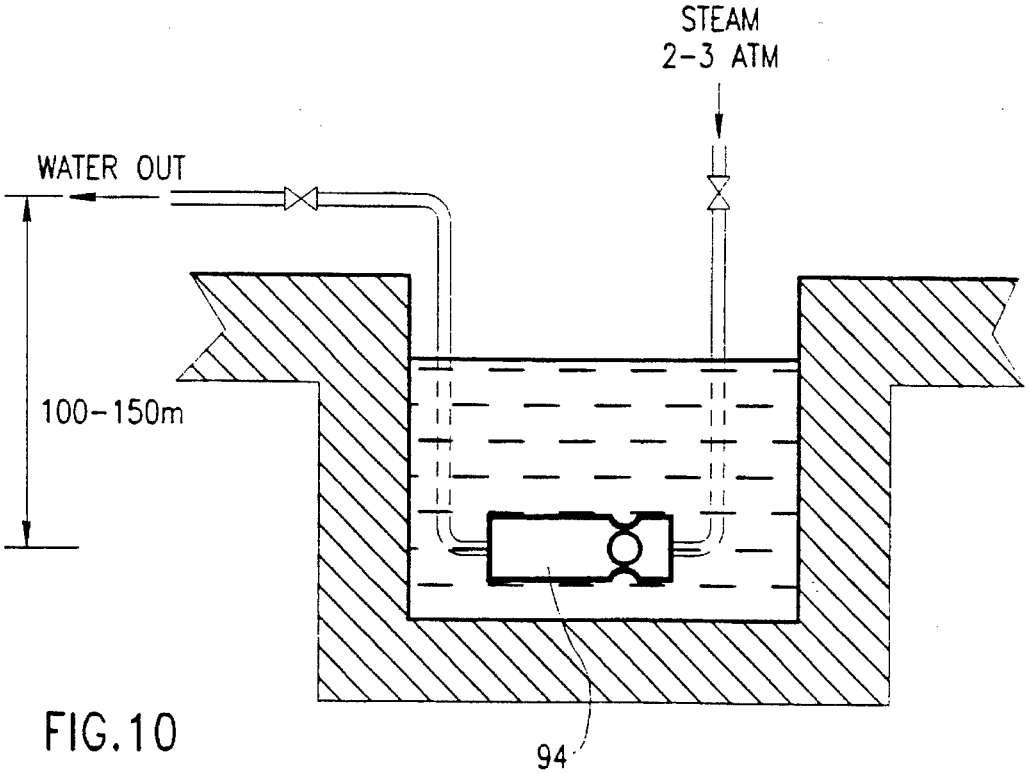
FIG. 10 is a simplified schematic drawing of application of the injector of FIG. 9 for pumping a liquid.

FIG. 10 shows a pumping system utilizing the injector of FIG. 9. Low pressure steam is again the driving force and the system can lift water 100–150 meters or more, depending on the flow rate and the steam pressure. Both inlet and outlet valves are preferably provided to control the steam pressure and the output flow/pressure. In this system, as the output flow is restricted, the pump will pump to higher levels.

Figure 11:
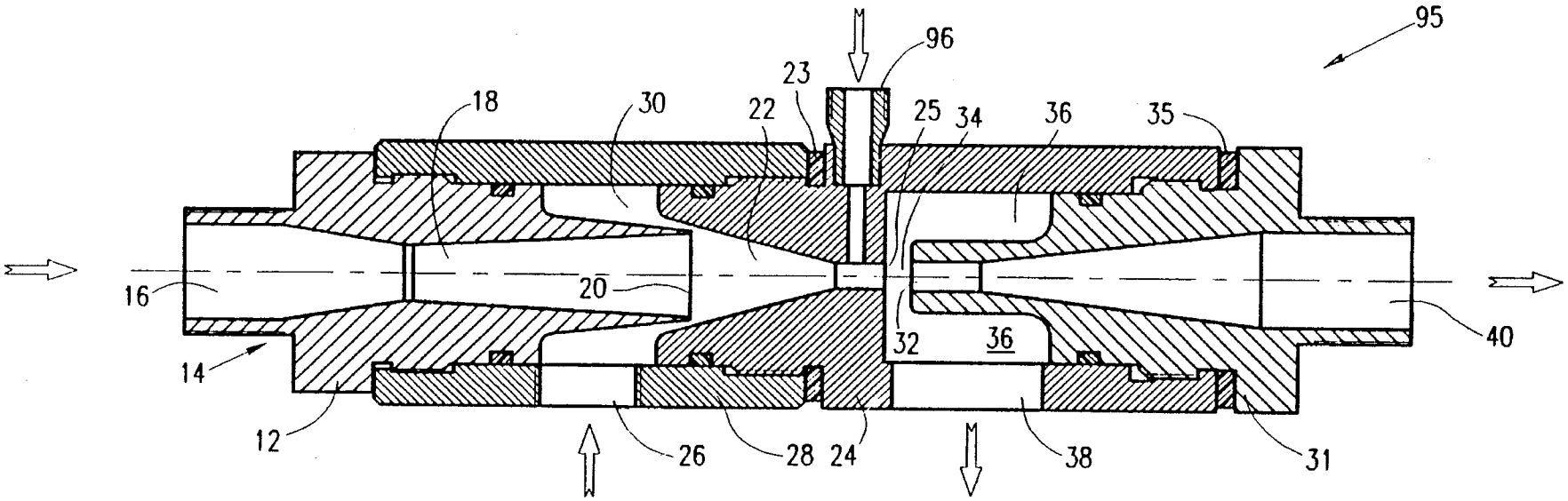
FIG. 11 is a cross-sectional drawing of an injector suitable for cleaning or foaming applications in accordance with a preferred embodiment of the invention.

FIG. 11 is a cross-sectional drawing of an injector 95 for heating water and adding cleaning material or foaming agent to the water and ejecting it at high pressure. It differs from the injector of FIG. 1 only in the provision of an auxiliary inlet 96 for the addition of cleaning or foaming material to the stream of steam and liquid. If more than one material is to be added to the water, multiple auxiliary inlets can be formed peripherally around the injector.

FIG. 12 is a schematic drawing of a system for providing hot water mixed with cleaning or foaming material such as detergent at high pressure. Injector 95 is fed by low pressure steam at inlet 16 and by water at city line pressure at inlet 28. Cleaning or foaming material is added from container 97 at auxiliary inlet 96 via one way valve 98. Valve 100 is used to control the cleaning or foaming material supply. High pressure hot water exits at outlet 40 and the flow is controlled by a user operated valve 102. Cleaning systems of the general outline of FIG. 12 using conventional injector nozzles are known. The present system, using the injector of the present invention, gives superior performance in that the steam which is used may be at a low pressure and the output stream is at a pressure 5 times that of the inlet water.

Figure 13:
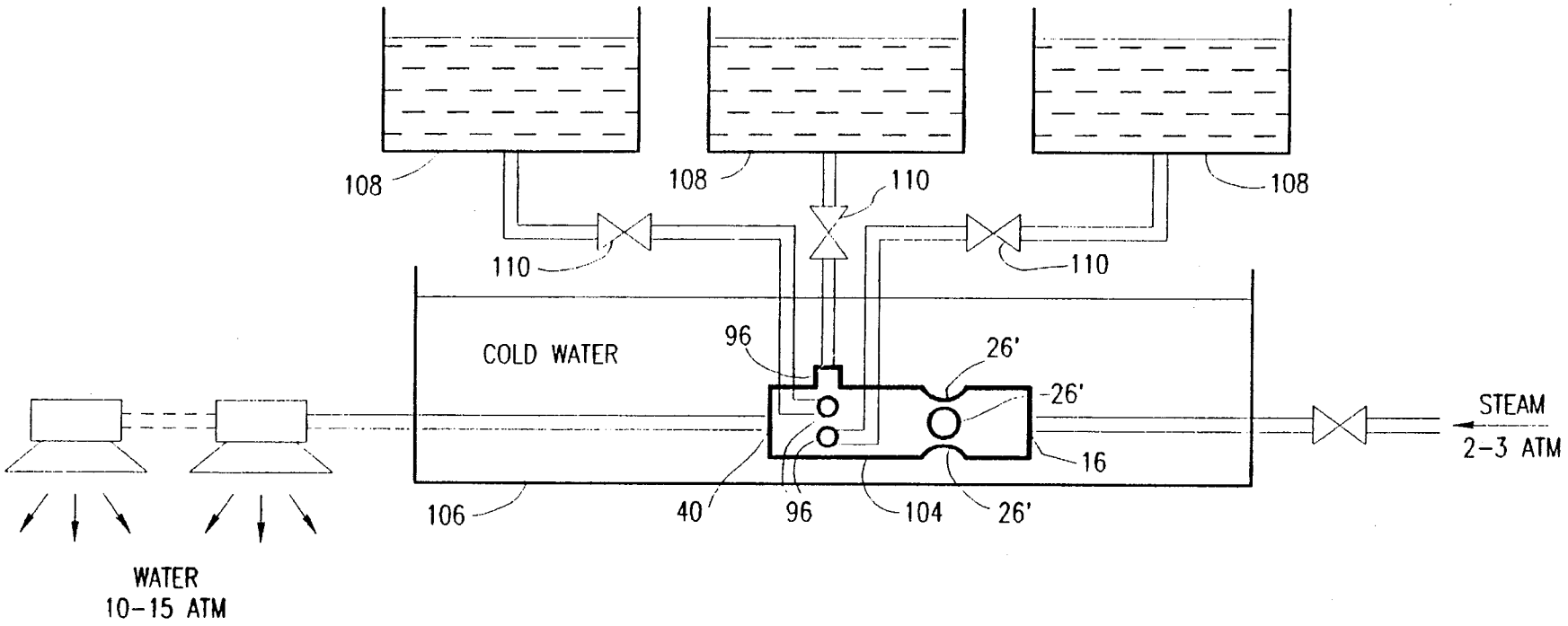
FIG. 13 is a simplified schematic drawing of a system suitable for cleaning or foaming applications utilizing an immersion type injector in accordance with a preferred embodiment of the invention.

An immersion type injector such as that of FIG. 9 can also be adapted for cleaning and/or foaming applications by the addition of one or more auxiliary inlets 96 to the injector as indicated in FIG. 11. FIG. 13 shows a system for providing foamed water or water containing a detergent at high pressure using such an immersion injector.

Injector 104 is immersed in a tank 106 of cold water. cleaning and or foaming materials are supplied from tanks 108 via valves 110 to auxiliary inlets 96. Low pressure steam is supplied to inlet 16 from an external source and the resultant high pressure treated and heated water leaves the injector at exit 40.

Figure 14:
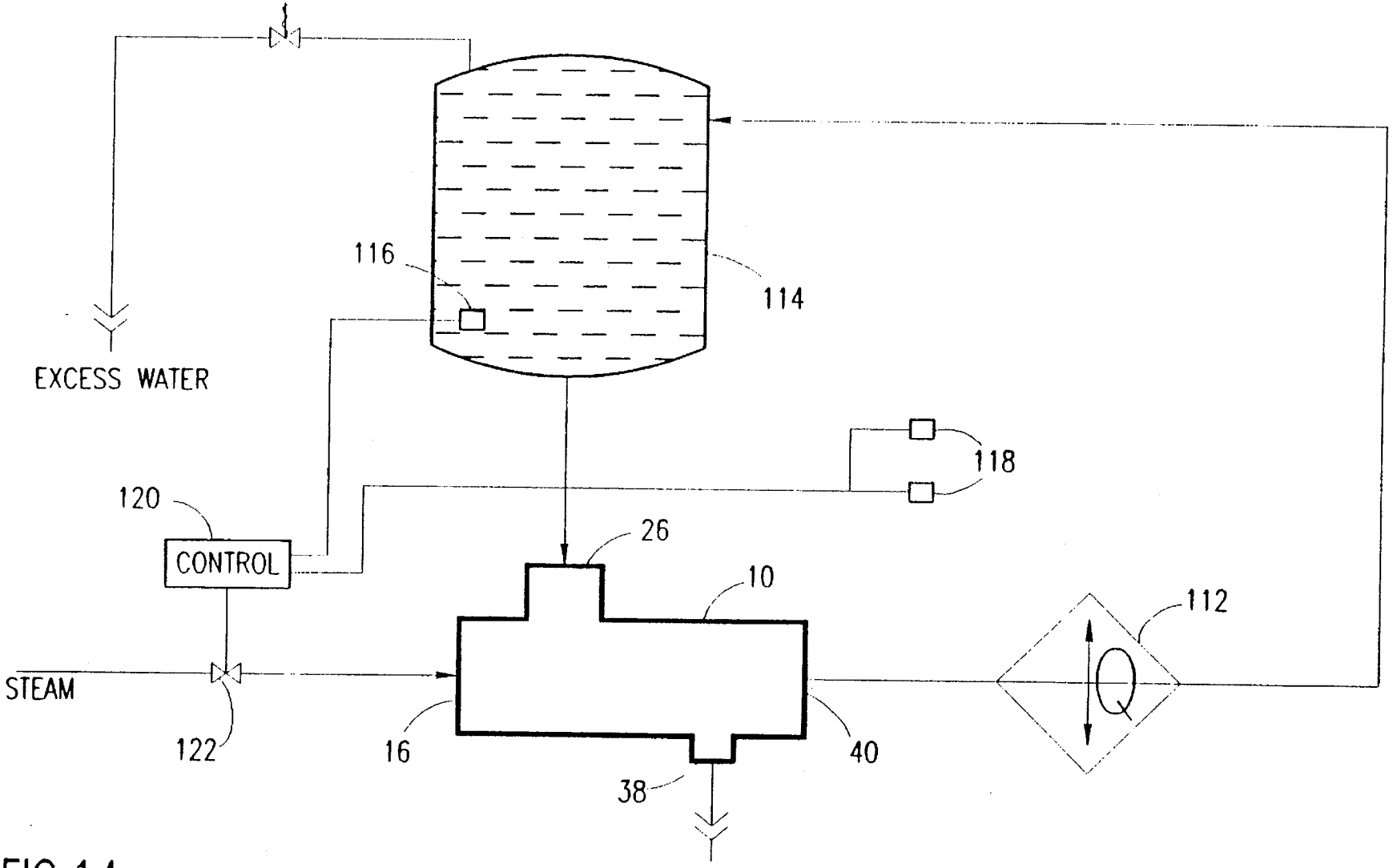
FIG. 14 is a simplified schematic drawing of a recirculating home heating system using an injector of the present invention.

FIG. 14 is a schematic drawing of a pumpless, hot water, space-heating system in accordance with a preferred embodiment of the invention. Injector 10 receives steam from an external source at inlet 16 and water from a tank at input 28. Hot water exits the injector at output 40 and travels through the system including radiators shown schematically at 112. Cool water is fed back into water tank 114 for reuse. Since the amount of water increases due to the addition of steam condensate to the system, excess water is removed from tank 114 and Via auxiliary outlet 38 for return, preferably, to the steam boiler. The steam boiler can be a small boiler for low pressure steam, since both the steam pressure and quantity of steam required is low. The temperature of the water in the tank is measured by a thermostat probe 116 and the supply of steam is cut off whenever the temperature rises above a preset safe level. Additional thermostats 118 are placed in various heating zones, and the steam is cut off when the room temperature rises above a set level by control 120 and valve 122. In an alternative embodiment of the invention, the injector can be an immersion type injector. In a multi-zone system, a plurality of injectors are used and individual thermostats activate those injectors which feed areas which need further heating.

It will be appreciated by persons skilled in the art that the present invention is not limited by what has been particularly shown hereinabove. In particular, certain features of the injector of the invention shown in some of the applications therefor can also be applied to other applications. Rather the invention is defined only by the claims which follow:

We claim:

1. An injector comprising:

a flow generator having a first inlet for gas or vapor at a first pressure and an outlet for gas or vapor having a supersonic velocity;

a mixing region having an inlet for the gas or vapor leaving the flow generator and a second inlet for a liquid at a second pressure, wherein liquid is incorporated into the flow of gas and vapor, the flow remaining at supersonic velocity; and a primary flow tube section aligned with an outlet of the mixing region and having an inlet and an injector outlet, the inlet of the flow tube being preceded by a gap surrounded by a cavity, wherein the flow velocity of the mixture is supersonic at the inlet of the primary flow tube section and the supersonic flow changes to subsonic flow within the primary flow tube section.

2. An injector according to claim 1 wherein the mixing region comprises:

a preliminary flow tube section having an inlet aligned with the mixing region inlet and an outlet substantially aligned with the primary flow tube section and separated therefrom by the gap.

3. An injector according to claim 1 and further characterized in that the flow changes from supersonic to subsonic at the entrance to the primary flow tube section.

4. An injector according to claim 1 and further characterized in that the flow changes from supersonic to subsonic within the primary flow tube section.

5. An injector according to claim 1 further characterized in that a shock wave region is formed within the primary flow tube section.

6. An injector according to claim 5 and including means for compressing the shock wave region.

7. An injector according to claim 1 wherein the outlet of the flow generator has a first cross-sectional area and the inlet of the primary flow tube section has a second cross-sectional area, wherein the first area is greater than four times the second area.

8. An injector according to claim 7 wherein the first area is greater than nine times the second area.

9. An injector according to claim 7 wherein the first area is greater than sixteen times the second area.

10. An injector according to claim 1 wherein the outlet of the flow generator has a first cross-sectional area and the inlet of the primary flow tube has a second cross-sectional area, wherein the first area is not greater than the second area.

11. An injector according to claim 10 wherein the first area is less than 70% of second area.

12. An injector according to claim 1 and having an outlet from the cavity to the exterior of the injector for the removal of liquid therefrom.

13. An injector according to claim 1 and including an exit from the primary flow tube downstream of the gap and communicating with an injector outlet, from which at least a portion of the material entering the primary flow tube exits the primary flow tube at a third pressure.

14. An injector according to claim 13 wherein the third pressure is at least four times the greater of the first and second pressures.

15. Apparatus for homogenizing comprising:

an injector according to claim 1;

a source of gas or vapor connected to the first inlet;

a source of unhomogenized material connected to the second inlet; and at least one outlet for homogenized material.

16. According to claim 15 and also comprising means, connected to at least one outlet, for controlling the degree of homogenization.

17. Apparatus according to claim 15 wherein the gas or vapor is steam.

18. Apparatus according to claim 15 wherein the source of material connected to the second inlet is milk.

19. Apparatus according to claim 18 wherein the milk exiting at the outlet is at a temperature of less than about 110° C.

20. Apparatus according to claim 15 wherein material exiting the at least one outlet is both sterilized and homogenized.

21. Apparatus for sterilizing comprising:

an injector according to claim 1;

a source of gas or vapor connected to the first inlet;

a source of unsterile material connected to the second inlet; and at least one outlet for sterilized material.

22. Apparatus according to claim 21 and also comprising means, connected to one of said at least on outlets, for controlling the degree of homogenization.

23. A fuel injection system comprising:

an injector according to claim 1;

a source of steam communicating with the first inlet;

a source of fuel communicating with the second inlet; and a combustion chamber communicating with an injector outlet.

24. Pumping apparatus comprising:

an injector according to any of claim 1;

a source of steam communicating with the first inlet; and a source of liquid communicating with the second inlet.

25. Heating apparatus comprising:

at least one injector according to claim 1;

a source of steam communicating with the first inlet;

a source of water communicating with the second inlet; and a heating system comprising at least one radiator communicating with the injector outlet.

26. Apparatus for providing a mixed and cooked product including:

at least one injector according to claim 1;

a source of steam communicating with the first inlet;

a source of powdered, ground or pureed uncooked food product mixed with water communicating with the second inlet; and an outlet for cooked food product.

27. An injector comprising:

a first inlet for vapor or gas at a first pressure;

a second inlet for liquid at a second pressure; and a port for liquid at a third pressure, characterized in that the injector is passive and the third pressure is at least four times the greater of the first and second pressures.

28. An injector according to claim 27 wherein the third pressure is at least five times the greater of the first and second pressures.

29. An injector according to claim 28 wherein the third pressure is at least eight times the greater of the first and second pressures.

30. A method of producing a liquid at a high pressure comprising the steps of:

supplying a gas or vapor at a first pressure;

supplying a liquid at a second pressure;

causing the gas or vapor to attain a velocity above the speed of sound;

mixing the gas or vapor with the liquid to form a stream of gas or vapor mixed with liquid while maintaining the velocity of the mixture above the speed of sound for the mixture;

causing the stream to flow in unconstrained flow over a predetermined distance;

feeding the unconstrained stream of gas or vapor and liquid mixture at supersonic speed into a primary flow tube section wherein the flow is constrained, wherein supersonic velocity is not maintained and the velocity of the mixture becomes subsonic.

31. A method according to claim 30 and including the step of feeding the mixed gas or vapor and liquid into a preliminary flow tube section prior to the unconstrained flow.

32. A method according to claim 30 and also including the step of forming a shock-wave region downstream the supersonic flow and prior to the formation of stable subsonic flow.

33. A method according to claim 32 and also including the step of constraining the extent of the shock-wave region.

34. A method according to claim 30 wherein the gas or vapor is a gas and wherein the flow changes from supersonic to subsonic at least partly as a result of dissolving of the gas in the liquid and comprising the step of removing the liquid/gas solution from the primary flow tube section at a third pressure.

35. A method according to claim 34 wherein the third pressure is at least four times the greater of the first and second pressures.

36. A method according to claim 35 wherein the third pressure is at least five times the greater of the first and second pressures.

37. A method according to claim 36 wherein the third pressure is at least eight times the greater of the first and second pressures.

38. A method according to claim 30 wherein the gas or vapor is a vapor and wherein the flow changes from supersonic to subsonic at least partly as a result of condensation of the vapor and comprising the step of removing the liquid from the primary flow tube section at a third pressure, 39. A method according to claim 30 and including the step of constricting an output of the primary flow tube section whereby the pressure thereat is increased.

40. A method according to claim 18 and including the step of providing an outlet for liquid from the cavity.

41. A heating apparatus comprising:

a passive injector having a first inlet, a second inlet and an injector outlet;

a source of steam communicating with the first inlet;

a source of water communicating with the second inlet; and a heating system comprising at least one radiator communicating with the injector outlet.

42. Apparatus according to claim 41 wherein the passive injector comprises:

a supersonic flow generator having an inlet communicating with the first inlet and an outlet for steam traveling at supersonic speed;

a mixing region having an inlet for the steam traveling at supersonic speed and an inlet communicating with the second inlet;

a flow section, wherein the flow changes from supersonic to subsonic velocity, the flow section having an inlet comprising an outlet of the mixing region and a flow section outlet, and being substantially aligned with the supersonic flow generator; and an outlet from the flow section communicating with the injector outlet.

43. Apparatus according to claim 42 and including a thermostatic control for hindering the flow of steam to the first inlet when the temperature of the water in the source of water rises above a first temperature.

44. Apparatus according to claim 42 and including a thermostatic control for hindering the flow of steam to the first inlet when the vicinity of the radiator rises above a second temperature.

45. Apparatus according to claim 41 and including a water return for returning water from the heating system to the source of water.

46. Apparatus for providing a mixed and cooked product including:

a passive injector having a first inlet, a second inlet and an injector outlet;

a source of steam communicating with the first inlet;

a source of powdered, ground or pureed uncooked food product mixed with water communicating with the second inlet; and an outlet for cooked food product.

47. Apparatus according to claim 46 wherein the passive injector comprises:

a supersonic flow generator having an inlet communicating with the first inlet and an outlet for steam traveling at supersonic speed;

a mixing region having an inlet for the steam traveling at supersonic speed and an inlet communicating with the second inlet;

a flow section, wherein the flow changes from supersonic to subsonic velocity, the flow section having an inlet comprising an outlet of the mixing region and a flow section outlet and being substantially aligned with the supersonic flow generator; and an outlet from the flow section communicating with the injector outlet.

* * * * *